US005705325A

United States Patent [19]

Hosoi

[11] Patent Number: 5,705,325

[45] Date of Patent: Jan. 6, 1998

[54] SILVER HALIDE PHOTOGRAPHIC LIGHT-SENSITIVE MATERIAL

[75] Inventor: Yuji Hosoi, Tokyo, Japan

[73] Assignee: Konica Corporation, Japan

[21] Appl. No.: 717,889

[22] Filed: Sep. 23, 1996

[30] Foreign Application Priority Data

Sep. 26, 1995 [JP] Japan ..... 7-247143

[51] Int. Cl.[6] ..... G03C 1/46; G03C 1/795; G03C 5/16

[52] U.S. Cl. ..... 430/502; 430/536; 430/939; 430/966

[58] Field of Search ..... 430/502, 509, 430/966, 536, 939

[56] References Cited

U.S. PATENT DOCUMENTS

| | | | |
|---|---|---|---|
| 3,923,515 | 12/1975 | Stappen | 430/966 |
| 4,585,729 | 4/1986 | Sugimoto et al. | 430/502 |
| 5,188,930 | 2/1993 | Funaki et al. | 430/536 |
| 5,354,648 | 10/1994 | Bucci et al. | 430/502 |
| 5,380,636 | 1/1995 | Malfatto et al. | 430/502 |
| 5,558,979 | 9/1996 | Ishigaki et al. | 430/502 |
| 5,582,964 | 12/1996 | Hashimoto et al. | 430/536 |

FOREIGN PATENT DOCUMENTS

0423712 A1 4/1991 European Pat. Off. .

OTHER PUBLICATIONS

European Search Report EP 96 11 5383 with Annex.

*Primary Examiner*—Richard L. Schilling

*Attorney, Agent, or Firm*—Jordan B. Bierman; Bierman, Muserlian and Lucas LLP

[57] ABSTRACT

A silver halide photographic light sensitive material comprising a support and at least two silver halide emulsion layers on each surface of the support, wherein 50% or more of said support are comprised of a syndiotactic polystyrene and a silver to binder ratio of the silver halide emulsion layer closest to said support is lower than that of another silver halide emulsion layer on each side of said support.

7 Claims, No Drawings

SILVER HALIDE PHOTOGRAPHIC LIGHT-SENSITIVE MATERIAL

INDUSTRIAL FIELD OF THE INVENTION

The present invention relates to a silver halide photographic light sensitive material, and especially to a silver halide photographic light sensitive material which is light in weight, excellent in handling properties and reduced in a fault such as roller mark occurrence.

BACKGROUND OF THE INVENTION

There are some silver halide photographic light sensitive materials in which stiffness is required. These kinds of materials tend to be heavy and difficult to handling. For example, in a silver halide photographic light sensitive film for medical use, a film having an image is hung on front of a viewing box for diagnosing, and therefore, in such a film, an appropriate stiffness is required to hang. For this reason, in a silver halide photographic light sensitive material employing a polyethylene terephthalate (PET) as the support, a 175 μm thick PET has been used.

However, because of its thickness, a box of one hundred such sheets amounts to about 4 kg, and is difficult in handling due to its heavy weight. So, a light sensitive material of a lower weight has been strongly demanded.

Therefore, there is proposal of a light sensitive material film employing a polyethylene naphthalate (PEN) instead of PET, but a PEN film absorbs light in the near ultraviolet range and cannot be applied to a light sensitive material film for duplicating.

A technique employing, as a support, a syndiotactic polystyrene (SPS) in place of PEN is also known. This SPS has stiffness higher than PET, and can give the same stiffness as PET in its lower density. Accordingly, SPS of the same thickness as PET has the advantage in that it has the same stiffness as, and a weight lower than, PET.

However, since SPS has high stiffness and hygroscopic expansion coefficient smaller than PET, a light sensitive material employing SPS has the disadvantage in that development faults called roller marks are likely to occur in its processing when employing an automatic processor.

SUMMARY OF THE INVENTION

An object of the present invention is to solve the above problems and to provide a silver halide photographic light sensitive material which is sufficiently stiff, light in weight, excellent in handling properties and reduced in pressure (contact) faults such as roller marks.

DETAILED DESCRIPTION OF THE INVENTION

The above object of the invention can be attained by the following:

a silver halide photographic light sensitive material comprising a support and at least two silver halide emulsion layers on each surface of the support, wherein 50% or more of said support are comprised of a syndiotactic polystyrene and a silver to binder ratio of the silver halide emulsion layer closest to said support is lower than that of another silver halide emulsion layer on each side of said support or a silver halide photographic light sensitive material comprising a support and at least two silver halide emulsion layers on each surface of the support, wherein 50% or more of said support are comprised of a syndiotactic polystyrene and a silver to binder ratio of the highest sensitive silver halide emulsion layer is lower than that of another silver halide emulsion layer.

The SPS in the invention, a film comprising as a main component a syndiotactic polystyrene (SPS) means a film comprising polystyrene having a stereo regularity, a syndiotactic structure, in which phenyl groups or substituted phenyl groups as a side chain are alternatively positioned on opposite sides to the polystyrene main chain. Generally, the film comprises polystyrene having mainly recemo chains in the polystyrene structure or a composition containing the polystyrene. This polystyrene, if a homopolymer, can be synthesized by polymerization disclosed in Japanese Patent O.P.I. Publication No. 62-117708/1987, and another styrene copolymer can be synthesized by polymerization disclosed in Japanese Patent O.P.I. Publication Nos. 1-46912/1989 and 1-178505/1989.

This tacticity is measured according to a nuclear magnetic resonance method using a carbon thirteen ($^{13}$C-NMR method).

This tacticity is measured according to a nuclear magnetic resonance method can be represented by the presence of successive plural styrene units, for example, two successive units called a diad, three successive units called a triad, and five successive units called a pentad. The polystyrene having mainly a syndiotactic structure in the invention has ordinarily not less than 75%, preferably not less than 85% of a recemo diad, or not less than 60%, preferably not less than 75% of a recemo triad, or not less than 30%, preferably not less than 50% of a recemo pentad.

The monomer capable of forming the syndiotactic styrene polymer which the composition contains includes styrene, an alkyl styrene such as methyl styrene, a halogenated or halogenated alkyl styrene such as chlorostyrene, chloromethylstyrene, an alkoxy styrene and vinylbenzoate. The alkylstyrene-styrene copolymer is especially preferable copolymer in obtaining a film having a thickness of not less than 50 μm.

The polystyrene in the invention having a syndiotactic structure can be obtained by polymerizing the above monomer in the presence of a catalyst such as a composition containing a transition metal compound and aluminoxane or a composition containing a transition metal compound and a compound capable of forming an ionic complex on reaction with the transition metal compound disclosed in Japanese Patent O.P.I. Publication No. 5-320448/1993, p. 4 to 10.

In order to manufacture the styrene polymer used in the invention, for example, the following method can be carried out. The above styrene monomer is purified and polymerized in the presence of the above described catalyst. The polymerization method, polymerization conditions (polymerization temperature, polymerization time), a solvent for polymerization may be appropriately selected. Ordinarily polymerization is carried out at −50° to 200° C., preferably 30° to 100° C., for 1 second to 10 hours, preferably 1 minute to 6 hours. The polymerization method includes a slurry polymerization, a solution polymerization, a bulk polymerization, and an air polymerization, and may be a continuous or discontinuous polymerization. The polymerization solvent includes an aromatic hydrocarbon such as benzene, toluene, xylene or ethylbenzene, an aliphatic hydrocarbon such as cyclopentane, hexane, heptane or octane or their combination. The ratio, monomer/solvent (by volume) can be arbitrarily selected. The control of the molecular weight or composition of a polymer obtained can be conducted according to a conventional method. The molecular weight can be controlled by hydrogen, polymerization temperature or a monomer concentration.

The described monomer may be copolymerized with another monomer, as long as the effect of the invention is not inhibited.

The weight average molecular weight of a polymer for an SPS (syndiotactic polystyrene) film has preferably not less than 10,000, more preferably not less than 30,000. When the molecular weight is less than 10,000, a film having excellent mechanical strength and heat resistance can not be obtained. The upper limit of the molecular weight is not limited, but a film having a molecular weight of 1,500,000 or more has a possibility of breakage due to an increase of orientation tension.

The molecular weight of the SPS polymer used in the photographic support in the invention is not limited, as long as it can form a film, but the weight average molecular weight of the polymer is preferably 10,000 to 3,000,000, and especially preferably 30,000 to 1,500,000.

The molecular weight distribution (number average molecular weight/weight average molecular weight) is preferably 1.5 to 8. The molecular weight distribution can be adjusted also by mixing polymers having a different molecular weight. In the syndiotactic polystyrene film used in the invention, the syndiotactic polystyrene pellets are preferably dried at 120° to 180° C. for 1 to 24 hours under vacuum condition or under an ordinary pressure atmosphere of air or an inactive air such as nitrogen. The moisture content of the syndiotactic polystyrene pellets is not limited, but is preferably 0.05% or less, more preferably 0.01% or less, and still more preferably 0.005% or less, in minimizing mechanical strength deterioration due to hydrolysis. However, the content is not limited thereto, as long as the above object is attained.

Polymerization example will be shown below.

(Polymerization Example)

A SPS pellet was manufactured according to a method disclosed in Japanese Patent O.P.I. Publication No. 3-31843/1991. All the operations from catalyst preparation to polymerization were carried out in the argon atmosphere. 17.8 g (71 mmol) of cupric sulfate pentahydrate ($CuSO_4.5H_2O$), 200 ml of purified benzene and 24 ml of trimethyl aluminium were put in a 500 ml glass vessel, and agitated at 40° C. for eight hours to prepare a catalyst. After this was filtered with glass filter of No. 3A in the argon atmosphere, and the filtered solution was freeze-dried. Then, the produced material was taken out and the produced material, tributyl aluminium pentamethylcyclopentadiethyl titanium trimethoxide were put into a stainless reaction vessel having the inner volume of 2 liters, and heated to 90° C. Then, 1 liter of purified styrene and 70 ml of purified methylstyrene were added to this and the mixture was subjected to polymerization reaction at this temperature for 8 hours. Thereafter, the resulting mixture was cooled to room temperature and one liter of methylene chloride was added, and a methanol solution of sodium methylate was added under agitation to deactivate the catalyst. After the mixture was added dropwise gradually into 20 liters of methanol, the precipitation was filtered with a glass filter and washed with methanol for three times, and dried. The weight average molecular weight measured by GPC using 1,2,4-trichlorobenzene as a solvent was 415,000 in terms of standard polystyrene.

The above obtained polymer had a melting point of 245° C. and had a syndiotactic structure from a carbon thirteen NMR measurement at 135° C. This polymer was extruded by an extruding machine to made pellets and dried at 130° C.

In the SPS film used in the invention, an SPS homopolymer made of styrene is preferable, but the film may be blended with a styrene polymer having an isotactic structure (IPS) in which the main chain is a meso chain, whereby a crystallization speed in this polymer can be controlled and a film having more mechanical strength can be obtained. When SPS is mixed with IPS, the mixture ratio, SPS:IPS is preferably 30:70 to 99:1, more preferably 50:50 to 98:2, although depending on stereoregularity of each polymer.

The support may contain inorganic fine particles, antioxidants, UV absorbers, antistatic agents, colorants, pigment or dyes.

For the extruding method at the time of manufacturing the film, any conventional method may be applied. For example, a extrusion method by the use of a T-die is preferable. The syndiotactic polystyrene pellets are melted at 280° to 350° C. and extruded, and cooled and solidified on a casting roll while applying electrostatic potential to obtain an unoriented film.

Next, this unoriented film is be oriented biaxially. For the method of orientation, a conventional method, for example, including one after another biaxial orientation method in which a longitudinal orientation and a lateral orientation are carried out in this order, one after another biaxial orientation method in which a lateral orientation and a longitudinal orientation are carried out in this order, a lateral-longitudinal-lateral orientation method, a longitudinal-lateral-longitudinal orientation method, a longitudinal-longitudinal-lateral orientation method or simultaneous biaxial orientation method may be used. the method may optionally be selected according to desirable characteristics such as mechanical strength and dimensional stability.

Generally, one after another biaxial orientation method in which a longitudinal orientation and a lateral orientation are carried out in this order is preferable, wherein the longitudinal and lateral orientation magnifications are 2.5 to 6 times and the temperature at the longitudinal orientation, although the temperature depends on the glass transition temperature (Tg), is preferably from Tg plus 10° C. to Tg plus 50° C. The orientation temperature is preferably 110° to 150° C. in the syndiotactic polystyrene film. The lateral orientation temperature is preferably 115° to 160° C. which is higher than the longitudinal orientation temperature. The oriented film is heat set. The heat set temperature optionally varies according to the usage. The heat set temperature is preferably 150° C. or less for package in which high shrinkage is desired, and preferably 150° to 270° C. for photographic, printing or medical use in which high dimensional stability is desired.

The heat set time is not specifically limited, but is ordinarily 1 to 2 minutes. At heat set treatment, longitudinal or lateral heat relaxation treatment may be optionally carried out.

The heat set film may be sharply cooled and wound around a core. It is preferable in view of anti-curling that after the film is gradually cooled from Tg to a heat set temperature in 0.1 to 1,500 hours and then wound around a core having a large diameter, the resulting material may be further cooled at from 40° C. to Tg at an average cooling speed of −0.01° to −20° C./minute. or further heat treated at high temperature before an emulsion coating.

The heat treatment of from 40° C. to Tg is preferably carried out in a thermostat in 0.1 minutes to 1500 hours during from the winding to emulsion coating.

Besides the above film manufacturing method, an SPS laminated film in which another SPS film having characteristics such as lubricity, adhesiveness or anti-static property is laminated on at least one side of an SPS film support can be manufactured in order to give the characteristics. The laminate method includes a method of laminating on a support a melted resin in a layer form and then extruding the laminated through a die or a method of extrusion laminating a melted SPS on a cooled and solidified unoriented or uniaxially oriented SPS support, orienting the laminated longitudinally and laterally or orienting the laminated in a direction perpendicular to the uniaxially oriented direction followed by heat setting. The extrusion condition, orientation temperature, orientation magnification, heat set temperature slightly varies depending on the combination of laminated films, but may be adjusted to select the optimal condition and is not greatly varied.

The laminated film is comprised of two or more layers, and may be a combination of the same polymers (copolymers) or different polymers.

The film manufacturing method varies depending on the usage or object of the film, and the invention is not limited thereto at any reason.

The thickness of the syndiotactic polystyrene oriented film is different depending on the usage, and is, for example, 0.3 μm for a thin condenser, 6 or 12 μm for a conventional condenser, 100 μm for a light sensitive material for graphic arts or medicine, or 250 μm for insulating material. The thickness of the film manufactured as above described is preferably 0.3 to 500 μm.

Next, a subbing layer coating carried out before coating an hydrophilic colloid layer in a silver halide photographic light sensitive material will be described below. Before the subbing layer coating, surface treatment such as chemical treatment, mechanical treatment, corona discharge, flame treatment, ultra-violet-rays treatment, high frequency electromagnetic waves treatment, glow discharge treatment, active plasma treatment or laser treatment is preferably carried out. The surface tension of a support is preferably not less than 50 dyne/cm by this treatment.

Any subbing layer known in the art can be used. The subbing layer may be a single layer, but preferably a double layer in view of enhancing adhesion for high function.

Next, the double layer coating of the subbing layer will be explained.

In the double layer coating, the first subbing layer is preferably a layer which is adhered to a support. The compound used in the first subbing layer includes a polymer or copolymer obtained by polymerization of an unsaturated carboxylic acid (such as methacrylic acid or acrylic acid) or its ester, styrene, vinylidene chloride or vinyl chloride and includes a water dispersible polyester, polyurethane, polyethyleneimine and epoxy resin.

Among these, the preferable example includes a copolymer comprising polystyrene and a water dispersible polyester. The copolymer comprising polystyrene and the water dispersible polyester will be explained below.

The above water dispersible polyester is a substantially linear polymer obtained by polycondensation of a polybasic acid or its ester derivative with a polyol or its ester derivative. The polybasic acid includes terephthalic acid, isophthalic acid, phthalic acid, phthalic anhydrede, 2,6-naphthalene dicarboxylic acid, 1,4-cyclohexane dicarboxylic acid, adipic acid, sebatic acid, trimellitic acid, pyromellitic acid, and dimer acid. Besides these, an unsaturated polybasic acid such as maleic acid, fumalic acid or itaconic acid or a hydroxy carboxylic acid such as p-hydroxybenzoic acid or p-(β-hydroxyethoxy)benzoic acid can be used in a small amount.

The polyol includes ethylene glycol, diethylene glycol, 1,4-butane diol, neopentyl glycol, dipropylene glycol, 1,6-hexane diol, 1,4-cyclohexane dimethanol, xylylene glycol, trimethylol propane, poly(ethyleneoxide)glycol, and poly (tetramethyleneoxide)glycol.

In order to give water dispersibility or solubility to the water dispersible polyester, the incoporation of a sulfonic acid, diethylene glycol or polyalkyleneether glycol in the ester is effective. The water dispesible polyester contains a dicarboxylic acid having a sulfonate salt (a dicarboxylic acid having a sulfonate salt and/or its ester derivative) in an amount of preferably 5–15 mol % based on the total dicarboxylic acid content.

The dicarboxylic acid having a sulfonate salt and/or its ester derivative used in a subbing layer is preferably a dicarboxylic acid having an alkali metal sulfonate salt, for example, an alkali metal salt of 4-sulfoisophthalic acid, 5-sulfoisophthalic acid, sulfoterephthalic acid, 4-sulfophthalic acid, 4-sulfonaphthalene-2,7-dicarboxylic acid or 5-(4-sulfophenoxy) isophthalic acid or its ester derivative. The dicarboxylic acid having a sulfonate salt and/or its ester derivative is especially preferably used in an amount of 6 to 10 mol % based on the total dicarboxylic acid content, in view of water solubility or water resistance.

The monomer of styrene polymers used in a subbing layer may be only styrene, and the monomer copolymerized with styrene includes alkylacrylate, alkylmethacrylate (alkyl includes methyl, ethyl, n-propyl, isopropyl, n-butyl, isobutyl, 2-hexylethyl, cyclohexyl, benzyl and phenylethyl), a hydroxy-containing monomer such as 2-hydroxyethylacrylate, 2-hydroxyethylmethacrylate, 2-hydroxypropylacrylate, 2-hydroxypropylmethacrylate, an amide-containing monomer such as acrylamide, methacrylamide, N-methylmethacrylamide, N-methylacrylamide, N-methylolmethacrylamide, N-methylolacrylamide, N,N-dimethylolmethacrylamide, N,N-dimethylolacrylamide, N-methoxymethylacrylamide, an amino-containing monomer such as N,N-diethylaminoethylacrylate, N,N-diethylaminoethylmethacrylate, an glycidyl-containing monomer such as glycidylacrylate, glycidylmethacrylate, a monomer containing a carboxyl group or its salt (sodium, potassium or ammonium salt) such as acrylic acid, methacrylic acid or its salt (sodium, potassium or ammonium salt), a monomer containing a sulfonic acid group or its salt such as styrene sulfonic acid group, vinyl sulfonic acid group or its salt (sodium, potassium or ammonium salt), a monomer containing a carboxyl group or its salt such as itaconic acid, maleic acid or fumalic acid or its salt (sodium, potassium or ammonium salt), an acid anhyride containing monomer such as maleic anhydride or itaconic anhydride, vinyl isocyanate, allylisocyanate, vinylethylether, vinylmethylether, acrylonitrile, ninyl chloride, vinyl acetate and vinylidene chloride. The above monmer can be copolymerized using one or mone kinds.

In order to modify the water dispesible polyester to a vinyl polymer, there is a method carrying out graft polymerization by copolymerization of a water dispesible polyester having an addition polymerizable group in the polyester ends with a vinyl type monomer or a method carrying out graft polymerization by polymerizing a vinyl type monomer having a condensation polymerizable group such as carboxyl, glycidyl or amino in the presence of a water dispesible polyester.

The polymerization initiator used in the polymerization includes ammonium persulfate, potassium persulfate and sodium persulfate, and is preferably ammonium persulfate.

The polymerization can be carried out without any surfactant and can be polymerized without a soap. However, in order to stabilize the polymerization, a surfactant such as a nonionic or anionic surfactant may be used as an emulsifying agent.

The weight content ratio of the water dispersible polyester to the vinyl polymer is 99/1 to 5/95, preferably 97/3 to 50/50, and more preferably 95/5 to 80/20.

The first subbing layer preferably contains a surfactant or a cellulose compound such as methylcellulose in order to improve coatability.

The subbing layer coating may be carried out after the above film manufacturing, but if the subbing layer composition can be oriented, the subbing layer coating may be carried out during the film manufacturing step such as a step before a longitudinal orientation, a step between a longitudinal and lateral orientation or a step after the lateral orientation and before a heat set. When the subbing layer composition cannot be oriented, for example, the subbing layer composition contains a polymer having a hydrophilic group, in which the interaction between the hydrophilic groups is too strong to be oriented, orientation can be carried out under a steam atomosphere or employing a subbing layer composition containing an orientation auxiliary such as polyglycerin.

The preferable of the monomers having a hydrophilic group include an unsaturated carboxylic acid such as acrylic acid, methacrylic acid or maleic anhydride. The content of such a monomer is preferably 1 to 10 weight %, more preferably 1 to 8 weight %, still more preferably 1 to r weight %, and most preferably 1 to 4 weight %. The copolymer may contain as a fourth monomer another copolymerizable monomer in an amount of 0 to 15 weight %, preferably 0 to 10 weight %. Such a monomer includes an alkyl-substituted styrene such as methylstyrene, a halogenated styrene such as chlorostyrene, chloromethylstyrene, an unsaturated nitrile such as acrylonitrile, an aliphatic ester such as methylacrylate, methylmethacrylate, t-butylacrylate, an alicyclic ester such as cyclohexylacrylate, an aromatic ester such as benzylacrylate, and a modified rubber compound such as butadiene or isoprene.

The manufacturing method of the copolymer is not limited, and the copolymer can be obtained by a radical polymerization due to a radical polymerization initiator.

The weight average molecular weight of the copolymer containing such a monomer is preferably 1,500 to 700,000, more preferably 2,000 to 500,000 in terms of standard polystyrene molecular weight measured by a GPC method.

The second subbing layer is preferably comprised of a hydrophilic binder layer in order to improve adherence to a photographic emulsion layer. The binder constituting the hydrophilic binder layer polymer includes a water soluble polymer such as gelatin, a gelatin derivative, casein, agar, sodium arginate, starch, polyvinyl alcohol, polyacrylic acid copolymer, carboxymethyl cellulose or hydroxyethyl cellulose and a mixture of polystyrene sodium sulfonate and a hydrophobic latex. Among these the most preferable is gelatin.

The second subbing layer preferably contains a hardener in order to enhance film strength. The hardener includes an aldehyde compound such as formaldehyde and glutaraldehyde, a reactive halogen-containing compound disclosed in U.S. Pat. Nos. 2,732,303 and 3,288,775 and British Patent Nos. 874,723 and 1,167,207, a ketone compound such as diacetyl or cyclopentanedione, bis(2-chloroethyl)urea, 2-hydroxy-4,6-dichloro-1,3,5-triazine, divinyl sulfone, 5-acetyl-1,3-diacroylhexahydro-1,3,5-triazine, a reactive olefin compound disclosed in U.S. Pat. Nos. 3,232,763 and 3,635,718 and British Patent No. 994,809, a vinylsulfone compound disclosed in U.S. Pat. Nos. 3,539,644 and 3,642,486, Japanese Patent Publication Nos. 49-13568/1974, 53-47271/1978 and 56-48860/1981, and Japanese Patent O.P.I. Publication Nos. 53-57257/1988, 61-128240/1986, 62-4275/1987, 63-53541/1988 and 63-264572/1988, N-hydroxymethylphthalimide, an N-methylol compound disclosed in U.S. Pat. Nos. 2,732,316 and 2,586,168, an isocyanate compound disclosed in U.S. Pat. No. 3,103,437, an aziridine compound disclosed in U.S. Pat. Nos. 2,983,611 and 3,107,280, an acid derivatives disclosed in U.S. Pat. Nos. 2,729,294 and 2,729,295, a carbodiimide compound disclosed in U.S. Pat. No. 3,100,704, an epoxy compound disclosed in U.S. Pat. No. 3,091,537, an isooxazole compound disclosed in U.S. Pat. Nos. 3,321,313 and 3,543,292, a halogenocarboxyaldehyde such as mucochloric acid, a dioxane derivative such as dihydroxydioxane or dichlorodioxane, and an inorganic hardener such as chrom alum, zirconium sulfate or chromium trichloride. As a hardener relatively rapidly hardening gelatin are known a dihydroquinoline skeleton containing compound disclosed in Japanese Patent O.P.I. Publication No. 50-30504/1075, an N-carbamoylpyridinium salt disclosed in Japanese Patent O.P.I. publication Nos. 51-59625/1976, 62-262854/1987, 62-264044/1987 and 63-184741/1988, an acylimidazole disclosed in Japanese Patent publication No. 55-38655/1980, an N-acyloxyimidazole disclosed in Japanese Patent publication No. 53-22089/1978, a compound having two or more N-acyloxyimino groups disclosed in Japanese Patent publication No. 53-22089/1978, a compound having an N-sulfonyloxyimino group disclosed in Japanese O.P.I. Patent publication No. 52-93470/1977, a compound having a phosphor-halogen bond disclosed in Japanese O.P.I. Patent publication No. 58-113929/1983 and a chloroformamidinium disclosed in Japanese Patent O.P.I. Publication Nos. 60-225148/1985, 61-240236/1986 and 63-41580/1988.

The second subbing layer preferably contains inorganic fine particles as a lubricant such as silica dioxide and titanium dioxide or an organic matting agent (1–10 μm) such as polymethyl methacrylate. Besides this agent, the upper subbing layer optionally contains various additives such as an anthalation agent, a coloring a gent, pigment or a coating auxiliary.

Of these additives, an antistatic agent is preferably contained in the subbing layer. The preferable antistatic agent includes a non-sensitive conductor and/or semiconductor fine particles.

The non-sensitive conductor and/or semiconductor fine particles used in the invention is an organic or inorganic material showing a conductivity due to a charge present in the particles such as a cation, an anion, an electron or a hole or a mixture thereof. The preferable is a compound having an electron conductivity. The organic compound thereof includes polymer fine particles such as polyaniline, polypyrrole or polyacetylene. The inorganic compound thereof includes fine particles of a metal oxide capable of forming an indefinite element ratio compound such as an oxygen-defect oxide, a metal-excessive oxide, a metal-defect oxide, an oxygen-excessive compound. The charge transfer complex or an organic-inorganic complex material includes a phosphasen metal complex. Of these, the most preferable is metal oxide fine particles, since various manufacturing methods can be used. In the invention a compound having a volume specific resistance of not more than $10^3$ Ω.cm is designated a conductor, and a compound having a volume specific resistance of not more than $10^{12}$ Ω.cm is designated a semiconductor.

The manufacturing method of the preferable conductive fine particles will be shown below. (Preparation example 1 of semiconductor fine particles)

In a 2000 cc water/ethanol were dissolved 65 g of stannic chloride hydrate to obtain a solution. The resulting solution was boiled to obtain co-precipitate. The co-precipitate was isolated by decantation and washed with distilled water several times. A silver nitrate solution was added to the distilled water dispersion to observed precipitation. After no precipitation was observed, 1000 cc of distilled water was added to the dispersion to make 2000 liter. Further, 40 cc of a 30% ammonia water were added and heated to obtain a colloidal gel dispersion solution.

(Preparation Example 2 of Semiconductor Fine Particles)

In a 1000 g ethanol were dissolved 65 g of stannic chloride hydrate and 1.5 g of antimony trioxide to obtain a solution. A 1N sodium hydroxide solution was added to the resulting solution to adjust to pH 3. Co-precipitate of colloidal stannic oxide and antimony oxide was produced and allowed to stand at 50° C. for 24 hours to obtain red-brown co-precipitate. The co-precipitate was separated by a centrifuge. In order to remove excess ion, the resulting precipitate was added with water and further separated by a centrifuge. This washing was repeated three times. The resulting colloidal precipitate of 100 g was mixed with 50 g of barium sulfate having an average particle diameter of 0.3 μm and 1,000 g of water and jetted into a baking furnace of 900° C. The bluish stannic oxide-barium sulfate powder mixture having an average particle size of 0.1 μm were obtained.

The concentration of the subbing layer coating solution is ordinarily not more than 20% by weight and preferably, not more than 15% by weight. The coating amount is 1 to 30 $g/m^2$, and preferably 5 to 20 $g/m^2$ in terms of coating solution weight.

As for a subbing layer coating method, various conventional coating methods can be employed. For example, a roll-coating method, a gravure-roll coating method, a spray coating method, an air-knife coating method, a bar coating method, a dip coating method and a curtain coating method can be used either individually or in combination.

The silver halide photographic light sensitive material of the invention can be used for such as a light sensitive material for an X-ray film, graphic arts, a conventional photographic film or a film for direct evaluation.

The silver to binder ratio in a silver halide photographic light sensitive material in the invention will be described below. The silver to binder ratio is defined as a ratio by weight of silver amount per unit area to binder amount per unit area in the emulsion layer.

It is necessary that the silver to binder ratio in the emulsion layer closest to a support is lower than that in another emulsion layer, and the silver to binder ratio in the emulsion layer closest to a support is preferably not less than 0.05 lower, more preferably not less than 0.1 lower, and still more preferably 0.1 to 0.5 lower, than that in another emulsion layer.

When there are two or more emulsion layers in a silver halide photographic light sensitive material, and the sensitivity of the emulsion layers are different, the silver to binder ratio in the highest sensitive emulsion layer is preferably 0.05 or more, more preferably 0.1 or more lower than that of other emulsion layers.

As a binder for a light sensitive material used in the invention, gelatin is preferable, but any hydrophilic colloid other than gelatin can be used.

The hydrophilic colloid other than gelatin includes gelatin derivatives, gelatin grafted with another polymer, protein such as alubmin or casein, a cellulose derivative such as hydroxyethyl cellulose, carboxymethyl cellulose or cellulose sulfate, sodium alginate, a saccharide such as dextran or starch derivative, and a synthetic hydrophilic polymer such as polyvinyl alcohol, polyvinyl alcohol patial acetal, poly-N-vinyl pyrrolidone, polyacrylic acid, polymethacrylic acid, polyacryl amide, polyvinyl imidazole, polyvinyl pyrazole and a copolymer thereof. The dextran or polyacrylamide each having an average molecular weight of 5,000 to 100,000 is preferably used in admixture with gelatin. The example thereof is disclosed in Japanese Patent O.P.I. Publication Nos. 1-307738/1989, 2-62532/1990, 2-24748/1990, 2-44445/1990, 1-66031/1989, 64-65540/1989, 63-101841/1988 and 63-153538/1988.

Gelatin includes lime-processed gelatin, acid-processed gelatin and enzyme-processed gelatin disclosed in Bull. Soc. Sci. Photo., Japan, No. 16, 30 (1966).

The emulsion used in a silver halide photographic light sensitive material may be any emulsion, and for example, is preferably an emulsion containing tabular silver halide grains having an average silver chloride content of preferably 10 mol % or more, more preferably 20 mol % or more and having an average aspect rationopf 2 or more. The silver halide grains may be silver bromide, silver iodobromide, silver bromochloride, silver iodobromochloride or silver chloride. The silver halide grain shape may be any shape, for example, cubic, octahedral, tetradecahedral, and twin crystals having various shapes.

An emulsion used for the photographic coating solution of the present invention can be produced by a conventional method. For example, methods described in 1. Emulsion Preparation and types in Research Disclosure (RD) No. 17643 (December, 1978), pp. 22 to 23 and RD. No. 18716 (November, 1979), on page 648 can be used.

The emulsion used for the photographic coating solution of the present invention can be prepared by methods described in "The Theory of the Photographic Process" 4th Edition (1977), written by T. H. James, published by Macmillan Inc., on pp. 38 to 104, "Photographic Emulsion Chemistry" (1966) written by G. F. Dauffin, published by Focal Press Inc., "Chimie et Physique Photographique" written by P. Glafkides, published by Paul Montel (1967) and "Making and Coating Photographic Emulsion" written by V. L. Zelikman and others, published by Focal Press Inc. (1964).

Namely, under a solution condition of a neutral method, an acid method and an ammonia method, a mixing condition of an ordinary mixing method, a reverse mixing method, a double jet method and a controlled double jet method and a grain preparation condition of a conversion method and a core/shell method and their mixture can be selected for producing the emulsion.

The grain size distribution of the silver halide grains may be a monodisperse emulsion having a narrow distribution or a polydisperse emulsion having a broad distribution. The monodisperse emulsion herein referred to means an emulsion comprising grains in which at least 90% by number or weight of grains falls within ±40%, preferably ±30% of a deviation from an average grain size.

The crystal structure of silver halide grains may have a halogen composition different in the inner portions and the surface, and the silver halide emulsions may be, for example, a monodisperse double-layered core/shell type emulsion in which a shell having a lower silver iodide content is covered with a core having a higher silver iodide content The above monodisperse emulsion is prepared by a conventional method, a method disclosed in, for example, J.

Photo. Soc., 12, 242–151(1963), Japanese Patent O.P.I. Publication Nos. 48-36890/1973, 52-16364/1977, 55-142329/1980 and 58-49938/1983, British Patent No. 1,413,748, and U.S. Pat. Nos. 3,574,628 and 3,655,394.

The silver halide emulsion layer used in the invention may be the monodisperse emulsion prepared by employing seed crystals, comprising supplying a silver ion and a halide ion to the seed crystals as growing nuclei.

The above described core/shell type emulsion is known, and can be prepared according to methods disclosed in, for example, J. Photo. Soc., 24, 198(1976), and U.S. Pat. Nos. 2,592,250, 3,505,068, 4,410,450 and 4,444,877 and 3,655,394 and Japanese Patent O.P.I. Publication Nos. 60-143331/1985.

The tabular silver halide grains lie in that improvement of spectral sensitization efficiency, improvement of the graininess and sharpness of images are obtained, as disclosed in British Patent No. 2,112,157 and U.S. Pat. Nos. 4,414,310 and 4,434,226. The emulsions can be prepared by a method described in these specifications.

The silver halide emulsion in the invention can be prepared to be an emulsion having a silver ion concentration suitable for chemical sensitization at completion of silver halide grain growth by an appropriate method. For example, a method such as a flocculation process or a noodle washing method disclosed in Research and Disclosure 17643 can be employed.

The emulsion in the invention is an emulsion having tabular silver halide grains having an aspect ratio of preferably 2 to 10, more preferably 3 to 8.

The spectral sensitizing dye used in the silver halide grains in the invention includes dyes known in the art such as cyanine dyes, carbocyanine dyes, dicarbocyanine dyes, complex cyanine dyes, hemicyanine dyes, styryl dyes, merocyanine dyes, complex merocyanine dyes, and holopolar dyes, and these dyes may be used singly or in combination.

The especially preferable sensitizing dyes are cyanine dyes, complex cyanine dyes, and complex merocyanine dyes. These dyes contain a nucleus ordinarily used in the cyanine dye as a basic heterocyclic nucleus such as a pyrroline, oxazoline, thiazoline, pyrrole, oxazole, thiazole, selenazole, imidazole, tetrazole, pyridine nucleus or its nucleus condensed with an aliphatic cyclic hydrocarbon ring such as an indolenine, benzindolenine, indole, benzoxazole, naphthoxazol, benzthiazole, naphthothiazole, benzoselenazole, benzimidazole, and quinoline. These nucleus may have a substituent at their carbon positions.

The merocyanine dyes or complex merocyanine dyes may contain, an a nucleus having a ketomethylene structure, a 5-or 6-membered heterocyclic ring such as a pyrazoline-5-one, thiohydantoin, 2-thiooxazolidine-2,4-dione, thiazoline-2,4-dione, rhodanine, or thiobarbituric acid nucleus.

These sensitizing dyes may be used singly or in combination. a combination of the sensitizing dyes is often employed for the purpose of supersensitization.

These sensitizing dyes may be added, directly or as a solution in which they are dissolved in a solvent such as water, methanol, ethanol, propanol, methylcellosolve, or 2,2,3,3-tetrafluoropropanol or a mixture solvent thereof, to a silver halide emulsion. The dyes may be added as a solution, disclosed in Japanese Patent Publication Nos. 44-23389/1969, 44-27555/969 and 57-22089/1982, containing dyes and an acid or base or as a solution or colloid dispersion, disclosed in U.S. Pat. Nos. 3,822,135 and 4,006,025, containing dyes and a surfactant such as sodium dodecylbenzenesulfonate. The dyes may be added as a dispersion in which dyes is dissolved in a solvent substantially immiscible in water such as phenoxyethanol and then dispersed in water or a hydrophilic colloid. The dyes may be added as a dispersion in which dyes are directly dispersed in a hydrophilic colloid as disclosed in Japanese Patent O.P.I. Publication Nos. 53-102733/1978 and 58-105141/1983.

These dyes may be added separately or in admixture, to a silver halide emulsion.

The silver halide photographic light sensitive material in the invention preferably latex. The ordinary latex is dispersed in an aqueous solution by a surfactant, but the latex is preferably stably dispersed by gelatin combined with a polymer latex. The gelatin and the polymer constituting latex may be combined through any bond. In such cases, the polymer and gelatin may be combined directly or through a cross-linking agent. The monomer constituting latex preferably contains a monomer having a reactive group such as a carboxyl, amino, amido, epoxy, hydroxy, aldehyde, oxazoline, ether, ester, methylol, cyano, acetyl group or an unsaturated carbon bond. The cross-linking agent include a conventional agent ordinarily used as a gelatin cross-linking agent such as an aldehyde, glycol, triazine, epoxy, vinylsulfone, oxazoline, methacroyl or acroyl type cross-linking agent.

The silver halide photographic light sensitive material in the invention may contain a hardener, thickener, gelatin plasticizer, matting agent or auxiliary coating agent as ordinarily used.

It is especially preferable that a carbonylpyridium type hardener as disclosed on pages 5–8 of Japanese Patent O.P.I. Publication No. 8-15802/1996.

The silver halide emulsion in the invention can be subjected to chemical sensitization which includes a sulfur sensitization, a gold sensitization, a noble metal sensitization such as a metal of Periodical Table VIII (Pd, Pt, Id etc.) or a combination thereof. Of these, a combination a gold compound, a sulfur compound and a selenium compound is preferable. The addition time of the selenium compound may be arbitrary, but preferably the selenium compound is added with sodium thiosulfate at chemical sensitization. The addition rate by mole of the selenium compound to the sodium thiosulfate is preferably not more than 1, and more preferably not more than ½. The reduction agent is preferably used in combination.

The chemical sensitization is preferably carried out in the presence of a compound having an absorption property to silver halide grains. As such a compound, azoles, diazoles, triazoles, tetrazoles, indazoles, thiazoles and pyrimidines, azaindenes are preferable, and these compounds having a mercapto group or a benzene ring are especially preferable.

A monomethine or trimethine dye is also preferably used.

To the grains of the silver halide emulsion in the present invention, reduction processing, so-called reduction sensitization can also be provided. This method can be provided to the silver halide emulsion by the use of a method to add a reductive compound, a method to pass through the silver ion excessive condition called silver ripening wherein pAg=1 to 7 or a method to pass through the high pH condition called high pH ripening wherein pH is 8 to 11.

The method to add the reductive compound is preferred because the degree of reduction sensitization can be adjusted delicately. Reductive compounds may be either an inorganic compound or an organic compound including thiodioxide urea, stannous salt, amines and polyamines, hydrazine derivatives, formamizine sulfinic acid, silane compounds, borane compounds, ascorbinic acid and its derivatives and sulfite. The especially preferable are thiodioxide urea, stannous chloride and dimethylborane. The added amount of reductive compound is different depending upon emulsion production conditions such as reductive property of the compound, kind of silver halide and dissolution conditions. It is appropriate that $1\times10^{-8}$ to $1\times10^{-2}$ mol per mol of silver halide. These reductive compounds are dissolved in an organic solvent such as water or alcohols and to add during the growth of the silver halide grains.

To the emulsion used in the silver halide photographic light sensitive material of the present invention, various photographic additives can be added during a physical ripening step or before or after a chemical ripening step. As additives used in such a step, for example, compounds described in RD Nos. 17643 (December, 1978), 18716 (November, 1979) and 308119 (December, 1989) are cited. Kind of compound and place described in these three RDs are illustrated as follows:

| | RD-17643 | | RD-18716 | | RD-308119 | |
|---|---|---|---|---|---|---|
| Additive | Page | Classification | Page | Classification | Page | Classification |
| Chemical sensitizer | 23 | III | 648 upper right | | 996 | III |
| Sensitizing dye | 23 | IV | 648–649 | | 996-8 | IVA |
| Desensitizing dye | 23 | IV | | | 998 | IVB |
| Pigment | 25–26 | VIII | 649–650 | | 1003 | VIII |
| Development accelerator | 29 | XXI | 648 upper right | | | |
| Anti-foggant and stabilizer | 24 | IV | 649 upper right | | 1006-7 | VI |
| Brightening agent | 24 | V | | | 998 | V |
| Hardener | 26 | X | 651 left | | 1004-5 | X |
| Surfactant | 26–7 | XI | 650 right | | 1005-6 | XI |
| Anti-static agent | 27 | XII | 650 right | | 1006-7 | XIII |
| Plasticizer | 27 | XII | 650 right | | 1006 | XII |
| Lubricant | 27 | XII | | | | |
| Matting agent | 28 | XVI | 650 right | | 1008-9 | XVI |
| Binder | 26 | XXII | | | 1003-4 | IX |

In the photographic processing method of the silver halide light-sensitive material in the present invention, when it is processed in an automatic processing machine including developing, fixing, washing and drying steps, steps from the development to the drying are comopleted preferably within 35 seconds, and more preferably within 30 seconds.

Namely, prominent effects can be obtained when the length of time from the starting point when a leading edge of the light-sensitive material is immersed in a developing solution to the time when the leading edge comes out of the drying zone through processing steps (so-called Dry to Dry time) is preferably within 45 seconds and mor preferably within 30 seconds.

Fixing is carried out preferably at 20° to 50° C. for 6 to 20 seconds and more preferably at 30° to 40° C. for 6 to 15 seconds.

Development time is preferably 5 to 45 seconds and more preferably 6 to 20 seconds. Development temperature is preferably 25° to 50° C. and more preferably 30° to 40° C.

For drying, hot air of preferably 35° to 100° C., and more preferably 40° to 80° C. is blown usually. In addition, a drier zone provided with a heating means using far infrared radiation or heat rollers may be equipped in an automatic developing machine.

An automatic developing machine (Japanese Patent O.P.I. Publication No. 3-264953/1991) wherein a mechanism to provide water or an acid linsing solution having no fixing ability to a light-sensitive material is provided between the above-mentioned developing, fixing and washing steps may also be used. In addition, to the automatic processing machine, a unit capable of preparing a developing solution or a fixing solution may be built in.

It is essential to contain in developer dihydroxy benzenes, and optionally p-aminophenols or pyrazolidones as a developing agent.

1,4-dihydroxy benzenes include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, 2,5-dimethylhydroquinone and hydroquinoemonosulfonic acid salt. Of these hydroquinone is especially preferable. p-Aminophenols include N-methyl-p-aminophenol, p-aminophenol, N-(β-hydroxyethyl)-p-aminophenol, N-(4-hydroxyphenyl)glycine, 2-methyl-p-aminophenol or p-benzylaminophenol). Of these N-methyl-p-aminophenol is especially preferable.

Pyrazolidones include 1-phenyl-3-pyrazolidone, 1-phenyl-4,4-dimethyl-3-pyrazolidone, 1-phenyl-4-ethyl-3-pyrazolidone, 1-phenyl-5-methyl-3-pyrazolidone, 1-phenyl-4-methyl-3-pyrazolidone, 1-phenyl-4-methyl-4-hydroxymethyl-3-pyrazolidone, 1-phenyl-4,4-dihydroxymethyl-3-pyrazolidone, 1,5-diphenyl-3-pyrazolidone, 1-p-tolyl-3-pyrazolidone, 1-phenyl-2-acetyl-4,4-dimethyl-3-pyrazolidone, 1-p-hydroxyphenyl-4,4-dimethyl-3-pyrazolidone, 1-(2-benzothiazolyl)-3-pyrazolidone and 3-acetoxy-1-phenyl-3-pyrazolidone.

The amount used of 1,4-dihydroxybenzene is preferably 0.01 to 0.7 mol, and more preferably 0.1 to 0.5 mol per liter of developer.

The amount used of p-aminophenols or pyrazolidones is preferably 0.0005 to 0.2 mol, and more preferably 0.001 to 0.1 mol per liter of developer.

The sulfites used in the developer include sodium sulfite, potassium sulfite, lithium sulfite, ammonium sulfite, sodium bisulfite, and potassium metabisulfite.

To the developing solution, a chelating agent whose chelate stability constant against iron ion is 8 or more can be contained. The iron ion referred here means ferric ($Fe^{3+}$).

The chelating agent whose chelate stability constant againt iron is 8 or more includes an organic carboxylic acid chelating agent, an organic phosphoric acid chelating agent, an inorganic phosphoric chelating agent or a polyhydroxy compounds.

Practical examples thereof include ethylenediamine diorthohydroxyphenyl acetic acid, triethylenetetramine acetic acid, diaminopropane tetraacetic acid, nitrilotriacetic acid, hydroxyethylethylenediamine triacetic acid, dihydroxyethylglycine, ethylenediamine diacetic acid, ethylenediamine dipropionate, imino diacetic acid, diethylenetriamine pentaacetic acid, hydroxyethyl imino diacetic acid, 1,3-diamino-2-propanol tetraacetic acid, transcyclohexanediamine tetraacetic acid, ethylenediamine tetraacetic acid, glycol ether amine tetraacetic acid, ethylenediamine-N,N,N',N'-tetrakismethylenephosphoric acid, nitrilo-N,N,N-trimethylenephosphoric acid, 1-hydroxyethilidene-1,1-diphosphoric acid, 1,1-diphosphonoethane-2-carboxylic acid, 2-phosphonobutane, 1,2,4-tricarboxylic acid, 1-hydroxy-1-phosphonopropane-1,2,3-tricarboxylic acid, cathecol-3,5-disulfonic acid, sodium pirolic acid, sodium tetrapoly phosphoric acid and sodium hexametha phosphoric acid.

To the developing solution, a hardener which strengthen layer physical property through hardening reaction with gelatin in the light-sensitive material during photographic processing. As a hardener, for example, gulutaric aidehyde, α-methylglutaric aidehyde, β-methylglutaric aidehyde, maleic dialdehyde, succinic dialdehyde, methoxysuccinic aidehyde, methylsuccinic dialdehyde, α-methoxy-β-ethoxyglutaric aidehyde, α-n-buthoxyglutaric aidehyde, α,α-dimethoxysuccinic dialdehyde, β-isopropyl succinic aidehyde, α,α-diethylsuccinic dialdehyde, butylmaleic dialdehyde or thie bisulfite added material.

As an additive other than the above-mentioned materials, development inhibitors such as sodium bromide and potassium iodide, organic solvents such as ethylene glycol, diethylene glycol, triethylene glycol, dimethylformamide, methylcellusolve, hexyleneglycol, ethanol and methanol or anti-foggants such as mercapto type compounds including 1-phenyl-5-mercaptotetrazole, 2-mercaptobenzimidazole-5-sulfonic acid sodium salt and benztriazole type compounds including 5-methylbenztriazole may be added. In addition, color regulators, surfactants and anti-foaming agents may be added.

The pH of the developing solution is preferably 9.0 to 12, and more preferably 9.0 to 11.5. An alkali agent or a buffer agent used for regulating pH includes pH regulators such as sodium hydroxide, potassium hydroxide, sodium carbonate, potassium carbonate, boric acid, sodium triphosphoric acid and potassium triphosphoric acid.

As a fixing solution, fixing solutions containing fixing agents such as sodium thiosulfate and ammonium thiosulfate can be used. Of them, in terms of fixing speed, ammonium thiosulfate is preferred. The amount used of these fixing agents is preferably about 0.1 to 6 mol/liter.

To the fixing solution, an aqueous solution of aluminium salt can be added as a hardener. In adition, alminium chloride, aluminium sulfate and potash alum can be used.

To the fixing solution, malic acid, tartaric acid, citric acid, gluconic acid or their derivatives can be used independently or two or more thereof can be used in combination. It is effective that these compounds are added in an amount of preferably 0.001 mol or more and more preferably 0.005 to 0.03 mol per 1 liter of fixing solution.

pH of the fixing solution is ordinarily 3.8 or more and preferably 4.2 to 7.0. When considering fixing hardening and the odor of sulforous acid, 4.3 to 4.8 is more preferable.

The pH elevation of the fixing solution due to running processing is preferably not more than 0.21, and more preferably 0.21 to 0.05.

In processing a silver halide photographic light sensitive material in the invention, a starter is preferably used in a developer or a developer replenisher. The pH lowering at running processing is minimized by using a developer replenisher having a pH higher than a developer. As a method of preparing a developer having a lower pH, a method obtaining a developer by adding a starter to a developer replenisher to lower the pH is preferable.

The starter may be acidic, and an organic acid, inorganic acid or a mixture thereof. The starter may be a solid or a solution, as long as it is soluble in a developer, and the solution is preferable. The example of the starter includes acetic acid, citric acid, boric acid, sulfuric acid and salicylic acid and their salt.

These acids may be used singly or in combination. The addition amount of the starter is preferably 0.1 to 100 g. per liter of developer, and more preferably 0.5 to 50 g per liter of developer. The pH lowering of developer due to addition of starter is preferably not less than 0.2, and more preferably 0.2 to 1.0.

The starter in the invention may contain additives other than the acids, and may contain a component such as halogen or hydroquinone monosulfonate accumulated in the developer in the development. The developer preferably contains a halogen such as KBr or KCl in an amount of 0.1 to 10 g per liter of developer.

The developed and fixed light sensitive material is followed by a washing or stabilizing process. The washing or stabilizing process is carried out in an amount of 3 liter or less (comprising 0, which means water stored in a reservoir) of water or stabilizer per $m^2$ of light sensitive material. This can not only save water but also remove a tube for supplying tap water which is provided in an automatic processor.

When washing is carried out with a small amount of water, a washing tank with squeezing rollers are preferably provided as disclosed in Japanese Patent O.P.I. Publication Nos. 63-18350/1988 and 62-287252/1987. In order to reduce a pollution load increasing in a small amount water washing, various oxidizing agents may be added or filtration may be carried out. A part or the whole of overflow produced from a washing or stabilizing bath, to which a sterilized water is replenished according to an amount of the processed light sensitive material, may be reused in the fixing bath in the fixing step before the washing or stabilizing step, as disclosed in Japanese Patent O.P.I. Publication No. 60-235133/1985.

A water soluble surfactant or anti-foaming agent may be added to a washing water or stabilizer in order to minimize unevenness due to foam on light sensitive material which is likely to occur when the light sensitive material is washed with a small amount of water, and to minimize transfer of processing components on squeezing rollers to the processed light sensitive material. Further, a dye-absorbing agent disclosed in Japanese Patent O.P.I. Publication No. 63-163456/1988 may be added to a washing water bath in order to minimize stainings due to dyes from the processed light sensitive material. The water soluble surfakrant or an anti-foaming agent may be added Stabilizing may be carried out after the water washing, and for example, a final processing of light sensitive material may be carried out employing a stabilizing bath containing the compounds disclosed in Japanese Patent O.P.I. Publication Nos. 2-201357/1990. 2-132435/1990, 1-102553/1989 and 46-44446/1971. The stabilizing bath optionally contains an ammonium compound, a metal (for example, Bi or Al) compound, a brightening agent, various chelating agents, a film pH adjusting agent, a hardener, a sterilizing agent, an anti-fungal, alkanolamines or a surfactant.

The water used in the washing or stabilizing process includes tap water, deionized water, and water sterilized with a halogen, ultraviolet rays and various oxidizing agents such as ozone, hydrogen perchlorate, or perchlorates).

EXAMPLES

The invention will be explained in the following examples, but the invention is not limited thereto.

Example 1

Preparation of Silver Halide Photographic Light Sensitive Material Sample (Preparation of Seed Emulsion 1)

A silver halide solution and a solution containing hydrogen peroxide treated gelatin and potassium bromide in the same mol as the silver halide were added at 40° C. to a 0.05N potassium bromide solution by a double-jet method while vigorously stirring, and after 1.5 minutes, the resulting mixture was cooled to 25° C. over 30 minutes, added with 80 ml per 1 mol of silver halide of an ammonia water (28%), and stirred for 5 minutes.

The resulting mixture was adjusted to pH 6.0 with acetic acid, added with an aqueous Demol solution and a magnesium sulfate solution to desalt, and added with a gelatin solution to redisperse. The resulting seed emulsion had spherical silver halide grains having an average grain size of 0.23 μm and a variation coefficient of 0.28.

(Preparation of Silver Bromochloride Emulsion)

(Emulsion B-1)

In a reaction vessel with a stirrer were incorporated seed emulsion 1 (in terms of 0.36 mol AgX), 6000 g of a distilled water containing a high methionine content gelatin (containing 59 μmol per gram of gelatin of methionine), 0.5 mol of $CaCl_2.2H_2O$ and 75 g of NaBr. The resulting solution was adjusted to pH 5.1, which was kept with NaOH or $HNO_3$. To the solution were added 1.6% of the total silver amount to be used over 4 minutes, using a 0.5 mol $AgNO_3$ solution, and 98.4% of the rest silver were added over 55 minutes at a linearly accelerated addition speed (final speed is 9.32 times the initial speed). A 30 ml 37 millimol adenine aqueous solution was added 4 minute and 16 minute after beginning of precipitation, and a 3.7 g 3M $CaCl_2$.solution was added 10 minute after beginning of precipitation. During the addition of the adenine solution and $CaCl_2$ solution, the incorporation of the $AgNO_3$ solution was stopped for 1 minute, and the precipitation was uniformly mixed. Thus, 1.44 mol of silver were precipitated.

Thus, a silver bromochloride emulsion comprising tabular silver bromochloride grains having an average silver chloride content of 50 mol %, an average grain size corresponding to sphere of 0.4 μm, a grain diameter of 1.2 μm in terms of projected area, a variation coefficient of 0.25 and an aspect ratio of 2.5 was obtained.

After the resulting emulsion was raised to 60° C., the following sensitizing dyes (A) and (B) were added in a given amount in a solid fine particle dispersion, and then a mixture solution containing adenine, ammonium thiocyanate, chloroauric acid and sodium thiosulfate and a triphenylphosphin selenide dispersion were added, and ripened for total 2 hours.

After completion of the ripening, 4-hydroxy-6-methyl-1.3.3a.7-tetrazaindene (TAI) as a stabilizer was added in a given amount.

Sensitizing dye (A)

5,5'-dichloro-9-ethyl-3,3'-di-(3-sulfopropyl)-oxacarbocyanine sodium salt anhydride Sensitizing dye (B)

5,5'-di-(butoxycarbonyl)-1,1-diethyl-3,3'-di-(4-sulfobutyyl)-benzoimidazolocarbocyanine sodium salt anhydride The addition amount (per mol of AgX) of the above additives is shown as follows.

| | |
|---|---|
| Sensitizing dye (A) | 430 mg |
| Sensitizing dye (B) | 4.3 mg |
| Adenine | 15 mg |
| Potassium thiocyanate | 95 mg |
| Chloroauric acid | 2.5 mg |
| Sodium thiosulfate | 2.0 mg |
| Triphenylphosphin selenide | 0.4 mg |
| 4-Hydroxy-6-methyl-1.3.3a.7-tetrazaindene (TAI) | 500 mg |

The solid fine particle dispersions of the sensitizing dyes were prepared in a similar manner as a method described in Japanese Patent O.P.I. Publication No. 5-297496/1993. The dispersion were obtained by adding the sensitizing dye in a given amount to 27° C. water and then stirring the mixture at 3.500 rpm for 30 to 120 minutes with a high speed stirrer (dissolver).

The above dispersion of a selenium sensitizer, triphenylphosphinselenide was prepared according to the following:

To 30 kg of a 50° C. ethyl acetate, 120 g of triphenylphosphinselenide was added, stirred and completely dissolved. In 38 kg of water, 3.8 kg of photographic gelatin were dissolved and 93 g of a 25 wt % sodium dodecylbenzene sulfonate aqueous solution were added. The above two solutions were mixed and dispersed at 50° C. through high speed dispersion apparatus equipped with a 10 cm dissolver at a dispersion blade periodical rate of 40 m/second for 30 minutes. Thereafter, the dispersion was stirred under reduced pressure to remove ethyl acetate and to give a residual ethyl acetate concentration of not more than 0.3 wt %. The resulting dispersion was added with water to make 80 kg. A part of the thus obtained dispersion was used for the above.

(Preparation of sample)

The following coating solutions were prepared. The addition amount is in terms of amount per 1 $m^2$ per one surface of light sensitive material.

| First Layer (Light Shielding Layer) | |
|---|---|
| Solid dye fine particle dispersion (AH) | 180 mg |
| Gelatin | 0.2 g |
| Sodium dodecylbenzene sulfonate | 5 mg |
| Compound (I) | 5 mg |
| 2 4-Dichloro-6-hydroxy-1,3,5-triazine sodium salt | 5 mg |
| Colloidal Silica (average diameter 0.014 μm) | 10 mg |
| Second Layer (Lower Emulsion Layer) | |

The emulsion obtained above was added with the following additives. The amount is in terms of a weight amount per mol of silver halide, unless otherwise specified.

| | |
|---|---|
| Compound (G) | 31.8 mg |
| 2,6-Bis(hydroxyamino)-4-diethylamino-1,3,5-triazine | 317.6 mg |
| t-Butyl-catechol | 8259 mg |
| Polyvinyl pyrroridone (molecular weight 10,000) | 2224 mg |
| Styrene-maleic acid anhydride copolymer | 5082 mg |
| Poly(sodium styrenesulfonate) | 5082 mg |
| Trimethylolpropane | 22235 mg |
| Diethylene glycol | 3176 mg |
| Nitrophenyl-triphenyl phosphonium chloride | 1271 mg |
| Ammonium 1,3-dihydroxybenzene-4-sulfonic acid | 31765 mg |
| 2-Mercaptobenzimidazole-5-sodiumsulfonate | 317.6 mg |
| Compound (H) | 31.76 mg |
| $n\text{-}C_4H_9OCH_2CH(OH)CH_2N(CH_2COOH)_2$ | 22235 mg |
| Compound (M) | 317.6 mg |
| Compound (N) | 317.6 mg |
| Latex (L) (in terms of solid) | 0.25 g/$m^2$ |
| Dextrin (average molecular weight 1000) | 21.2 g |

The second layer was coated to be in a gelatin amount per one surface as shown in Table 1.

Third Layer (Upper Emulsion Layer)

The emulsion obtained above was added with the following additives. The amount is in terms of a weight amount per mol of silver halide, unless otherwise specified.

| | |
|---|---|
| Compound (G) | 31.8 mg |
| 2,6-Bis(hydroxyamino)-4-diethylamino-1,3,5-triazine | 317.6 mg |
| t-Butyl-catechol | 8259 mg |
| Polyvinyl pyrroridone (molecular weight 10,000) | 2224 mg |
| Styrene-maleic acid anhydride copolymer | 5082 mg |
| Poly(sodium styrenesulfonate) | 5082 mg |
| Trimethylolpropane | 22235 mg |
| Diethylene glycol | 3176 mg |
| Nitrophenyl-triphenyl phosphonium chloride | 1271 mg |
| Ammonium 1,3-dihydroxybenzene-4-sulfonic acid | 31765 mg |
| 2-Mercaptobenzimidazole-5-sodiumsulfonate | 317.6 mg |
| Compound (H) | 31.76 mg |
| $n\text{-}C_4H_9OCH_2CH(OH)CH_2N(CH_2COOH)_2$ | 22235 mg |
| Compound (M) | 317.6 mg |
| Compound (N) | 317.6 mg |
| Latex (L) (in terms of solid) | 0.25 g/m$^2$ |
| Dextrin (average molecular weight 1000) | 21.2 g |

The third layer was coated to be in a gelatin amount per one surface as shown in Table 1.

Fourth Layer (Protective Layer)

| | |
|---|---|
| Gelatin | 0.7 g |
| Polymethylmethacrylate matting agent (having an area average grain size of 7.0 μm) | 50 mg |
| 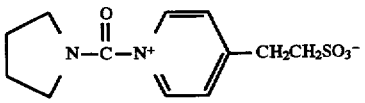 | 100 mg |
| 2,4-Dichloro-6-hydroxy-1,3,5-triazine sodium salt | 10 mg |
| Bis-vinylsulfonylmethylether | 36 mg |
| Latex (L) | 0.2 g |
| Polyacrylamide (molecular weight 10,000) | 0.1 g |
| Polysodium acrylate | 30 mg |
| Compound (SI) | 20 mg |
| Compound (I) | 12 mg |
| Compound (J) | 2 mg |
| Compound (S-1) | 7 mg |
| Compound (K) | 15 mg |
| Compound (O) | 50 mg |
| Compound (S-2) | 5 mg |
| $C_9H_{19}-O-(CH_2CH_2O)_{11}-H$ | 3 mg |
| $(C_8F_{17}SO_2)(C_3H_7)N(CH_2CH_2O)_{15}H$ | 2 mg |
| $(C_8F_{17}SO_2)(C_3H_7)N(CH_2CH_2O)_4-(CH_2)_4SO_3Na$ | 1 mg |

Latex L

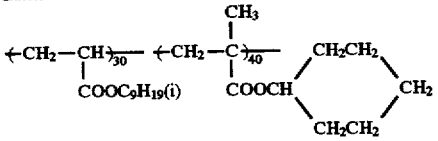

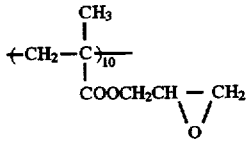

Compound (I)

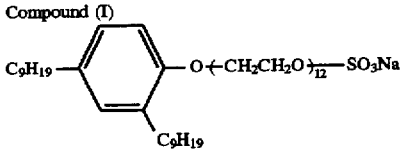

-continued

Compound (G)

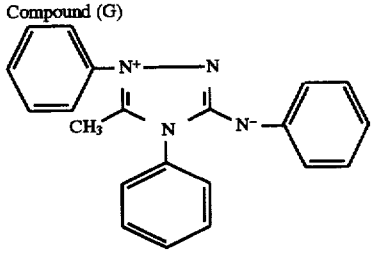

Compound (H)

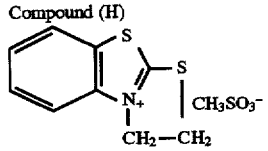

Solid fine particle dispersion dye (AH)

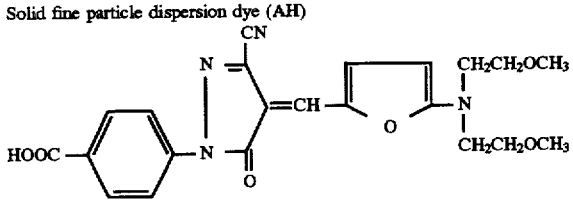

Compound (M)

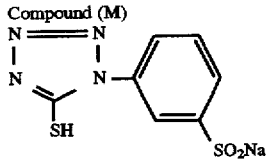

Compound (N)

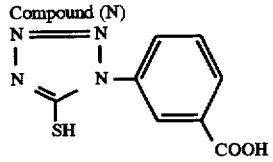

Compound (J)

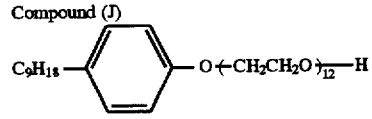

Compound (SI)

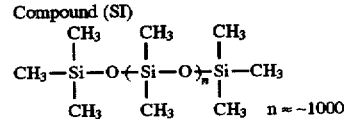

Compound (S-1)

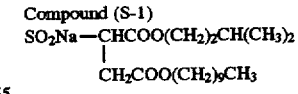

Compound (K)

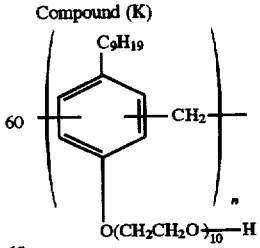

a mixture of compounds in which n is 2 to 5

-continued

Compound (O)
$C_{11}H_{23}CONH(CH_2CH_2O)_3H$
Compound (S-2)

$$NaO_3S-\underset{\underset{CH_2COOCH_2(C_2F_4)_3F}{|}}{CH}COOCH_2(C_2F_4)_3F$$

The above coating solutions, the light shielding solution, emulsion solutions and protective solution were simultaneously multilayer-coated in that order on the each surface of the blue-colored subbed support prepared according to a method described later in 2 minutes and 20 seconds at a coating speed of 100 m/minute, employing two slide-hopper type coaters and dried. Thus, light sensitive materials as shown in Table 1 were prepared. The coating silver amount per one surface was adjusted to have the silver content per one surface as shown in Table 1.

The developer and fixer compositions used in the invention are as follows:

| | |
|---|---|
| Developer composition | |
| Part A (for 12 liter) | |
| Potassium hydroxide | 450 g |
| Potassium sulfite (50% solution) | 2280 g |
| Diethylene tetramine pentaacetate | 120 g |
| Sodium bicarbonate | 132 g |
| Boric acid | 40 g |
| 5-Methylbenzotriazole | 1.4 g |
| 1-Phenyl-5-mercaptotetrazole | 0.25 g |
| 4-Hydroxymethyl-4-methyl-1-phenylpyrazolidone | 102 g |
| Hydroquinone | 390 g |
| Diethylene glycol | 550 g |
| Water added to make 6000 ml. | |
| Part B (for 12 liter) | |
| Glacial acetic acid | 70 g |
| 5-Nitroindazole | 0.6 g |
| Glutaraldehyde (50% solution) | 8.0 g |
| N-acetyl-DL-penicillamine | 1.2 g |
| Starter | |
| Glacial acetic acid | 120 g |
| $HO(CH_2)_2S(CH_2)_2S(CH_2)_2OH$ | 1 g |
| Potassium bromide | 225 g |
| $CH_3N(C_3H_6NHCONHC_2H_4SC_2H_5)_2$ | 1.0 g |
| Water added to 1 liter. | |
| Fixer composition | |
| Part A (for 18.3 liter) | |
| Ammonium thiosulfate (70 wt/vo %) | 4500 g |
| Sodium sulfite | 450 g |
| Sodium acetate | 450 g |
| Boric acid | 110 g |
| Tartaric acid | 60 g |
| Sodium citrate | 10 g |
| Gluconic acid | 70 g |
| 1-(N,N-dimethylamino)ethyl-5-mercaptotetrazole | 18 g |
| Glacial acetic acid | 330 g |
| Aluminum sulfate | 62 g |
| Water added to 7200 milliliter. | |

Parts A and B of the developer composition were incorporated in 5 liter water while stirring and water was added to make 12 liter. The resulting developer was adjusted to pH 10.40. Thus, Developer replenisher was prepared.

To 1 liter of the developer replenisher were added 20 ml/liter of the starter described above and pH was adjusted to 10.30. Thus, developer to be used was obtained.

In preparing fixer, Part A of the fixer composition was incorporated in 5 liter water while stirring and water was added to make 18.3 liter. The resulting fixer was adjusted to pH 4.6 with sulfuric acid and NH40H. Thus, fixer replenisher was prepared.

The processing steps were as follows:

Processing Steps

| Steps | Temperature (°C.) | Processing Time (second) |
|---|---|---|
| Development and Cross-over | 35 | 7.2 |
| Fixing and Cross-over | 33 | 5.8 |
| *Washing and Cross-over | 18 | 3.8 |
| Squeezing | 40 | 2.8 |
| Drying | 50 | 5.4 |
| Sum | | 25.0 |

*Washing water was supplied in an amount of 7 liter/minute.

[Preparation of a Support]

Polymerization Example

ASPS pellet was manufactured according to the method disclosed in Japanese Patent O.P.I. Publication No. 3-131843/1991. All the operations from catalyst preparation to polymerization were carried out in the argon atmosphere. 17.8 g (71 mmol) of cupric sulfate pentahydrate ($CuSO_4.5H_2O$), 200 ml of purified benzene and 24 ml of trimethyl alumminium were put in a 500 ml glass vessel, and agitated at 40° C. for eight hours to prepare a catalyst. After this was filtered with glass filter of No. 3A in the argon atmosphere, and the filtered solution was freeze-dried. Then, the produced material was taken out and the produced material, tributyl aluminium pentamethylcyclopentadienyl titanium trimethoxide were put into a stainless reaction vessel having the inner volume of 2 liters, and heated to 90° C.

Then, 1 liter of purified styrene was added, and 70 ml of purified methylstyrene were further added to this and the mixture was subjected to polymerization reaction at this temperature for 8 hours. Thereafter, the resulting mixture was cooled to room temperature and one liter of methylene chloride was added, and a methanol solution of sodium methylate was added under agitation to deactivate the catalyst. After the mixture was added dropwise gradually into 20 liters of methanol, the precipitation was filtered with a glass filter of No. 3 and washed with 1 liter of methanol for three times, and this was dried. Thus, a SPS polymer was obtained. The weight average molecular weight of this polymer measured by GPC using 1,2,4-trichlorobenzene as a solvent was 415,000 in terms of standard polystyrene. The melting point of this polymer was 245° C. The above obtained polymer had a syndiotactic structure from a carbon thirteen NMR measurement.

This SPS polymer was made pellet and dried at 130° C.

(Preparation of SPS Film)

The above SPS polymer was melt-extruded at 330° C. by an extruder, extruded through a pipe on an extruding die, and extruded on a cooled casting drum from a die-slit while applying electrostatic potential and cooled. Thus, to obtain an unoriented 1000 μm thick SPS sheet was obtained.

The resulting sheet was heated to 115° C. and firstly oriented in the longitudinal direction with an orientation magnification degree of 3.3 times, and the resulting sheet was pre-heated to 115° C. and further oriented at 135° C. in the lateral direction with the orientation magnification degree of 3.3 times. The resulting sheet was heat set at 225° C. while relaxing in the lateral direction. Thus, a 100 μm thick SPS film was obtained.

The surface of the thus obtained SPS film were subjected for 2 minutes to a 23 W/m corona discharge treatment, and discharged with an ion wind. Thereafter, subbing layer coating solution 1 was coated on the surface of the film so that the dry thickness of the layer was set to be 1.0 μm, and, subsequently dried at 140° C. to obtain a subbing layer.

| Subbing layer coating solution 1 | |
|---|---|
| Styrene-butadiene latex (No. 619; product of Nihon Goseigomu Co., Ltd.) | 40 parts by weight |
| Styrene-butadiene latex (No. 640; product of Nihon Goseigomu Co., Ltd.) | 50 parts by weight |
| Polystyrene matting agent (average diameter: 3μ) | 5 parts by weight |
| 2,4-Dichloro-1,3,5-triazine sodium salt | 3 parts by weight |
| Sodium dodecylbenzenesulfonate | 2 parts by weight |

Next, the subbing layer was further subjected for 2 minutes to a 18 W/m corona discharge treatment and coated with the following solution so that the dry thickness of the layer was set to be 0.1 μm, and, subsequently dried at 140° C.

| | |
|---|---|
| Gelatin | 80 parts by weight |
| Methyl cellulose | 15 parts by weight |
| Sodium dodecylbenzenesulfonate | 3 parts by weight |
| 2,4-Dichloro-1,3,5-triazine sodium salt | 2 parts by weight |
| Water added to make a 100 g solution. | |

The surface opposite the subbing layer of the resulting film were subjected for 2 minutes to a 23 W/m corona discharge treatment, and discharged with an ion wind. Thereafter, subbing layer coating solution 2 was coated on the surface so that the dry thickness of the layer was set to be 1.0 μm, and, subsequently dried at 140° C.

| Subbing layer coating solution 2 | |
|---|---|
| Styrene-butadiene latex (No. 619; product of Nihon Goseigomu Co., Ltd.) | 50 parts by weight |
| Styrene-butadiene latex (No. 640; product of Nihon Goseigomu Co., Ltd.) | 40 parts by weight |
| Polystyrene matting agent (average diameter: 3μ) | 5 parts by weight |
| 2,4-Dichloro-1,3,5-triazine sodium salt | 3 parts by weight |
| Sodium dodecylbenzenesulfonate | 2 parts by weight |

Next, the subbing layer was further were subjected for 2 minutes to a 18 W/m corona discharge treatment and coated with the following solution so that the dry thickness of the layer was set to be 0.1 μm, and, subsequently dried at 140° C.

| | |
|---|---|
| Gelatin | 20 parts by weight |
| Methyl cellulose | 5 parts by weight |
| **Crystalline tin oxide fine particles (antimony doping) | 70 parts by weight |
| Sodium dodecylbenzenesulfonate | 3 parts by weight |
| 2,4-Dichloro-1,3,5-triazine sodium salt | 2 parts by weight |
| Water added to make a 100 g solution. | |

**The particles were prepared according to a method described above in "Preparation example 2 of semiconductor fine particles".

The resulting subbed support was wound around a 40 cm core at 50° C., and stored for 3 days at this temperature.

The resulting light sensitive material obtained above was subjected to the above processing and evaluated for roller mark occurrence. The evaluation criteria are as follows:

Rank No. 3 shows a limited level accepted on the market, Rank No. 5 no roller mark occurrence level, and Rank No. 1 roller mark occurrence on the film surface, which is a level not accepted on the market.

The results are shown in Table 1. As is apparent from Table 1, inventive samples show excellent results in the roller mark evaluation.

TABLE 1

| | Lower Emulsion Layer | | | Upper Emulsion Layer | | | Roller Mark | |
|---|---|---|---|---|---|---|---|---|
| Sample No. | Ag Amount g/m² | Binder Amount g/m² | Ag to Binder Ratio | Ag Amount g/m² | Binder Amount g/m² | Ag to Binder Ratio | Occurrence Rank No. | Re-marks |
| 1 | 0.51 | 0.6 | 0.85 | 1.19 | 1.4 | 0.85 | 2 | Comp. |
| 2 | 0.51 | 0.567 | 0.9 | 1.19 | 1.433 | 0.835 | 1.5 | Comp. |
| 3 | 0.51 | 0.537 | 0.95 | 1.19 | 1.463 | 0.81 | 1 | Comp. |
| 4 | 0.51 | 0.51 | 1.0 | 1.19 | 1.49 | 0.8 | 1 | Comp. |
| 5 | 0.51 | 0.64 | 0.8 | 1.19 | 1.360 | 0.845 | 3.5 | Inv. |
| 6 | 0.51 | 0.68 | 0.75 | 1.19 | 1.32 | 0.9 | 4 | Inv. |
| 7 | 0.51 | 0.714 | 0.7 | 1.19 | 1.286 | 0.925 | 5 | Inv. |
| 8 | 0.51 | 0.785 | 0.65 | 1.19 | 1.215 | 0.979 | 5 | Inv. |

Example 2

Silver bromochloride emulsions were prepared in the same manner as in Example 1, except that the amount of the seed emulsion was controlled. Thus, a silver halide emulsion comprising silver halide grains 5% larger in grain size than those of Example 1 and a silver halide emulsion comprising silver halide grains 5% smaller in grain size than those of Example 1 were prepared, and then chemically and spectrally sensitized in the same manner as in Example 1. The chemical ripening agents and sensitizing dyes were added in such a manner that their addition amount per grain surface area was equal.

The thus obtained emulsions having large, medium and small grain sizes were designated Em-1, Em-2 and Em-3 in that order, respectively. Em-1 has highest sensitivity. Silver halide photographic light sensitive material samples were prepared in the same manner as in Example 1, except that three emulsions coating solutions from the above emulsions were coated. The additives were added to the emulsion coating solutions in such a manner that their addition amount per silver weight was the same as in Example 1.

The results are shown in Table 2. As is apparent from Table 2, inventive samples show more excellent results in this Example.

TABLE 2

| | Lower Emulsion Layer | | | | Intermediate Emulsion Layer | | | | Upper Emulsion Layer | | | | Roller | |
|---|---|---|---|---|---|---|---|---|---|---|---|---|---|---|
| Sample No. | Emulsion | Ag Amount g/m² | Binder Amount g/m² | Ag to Binder Ratio | Emulsion | Ag Amount g/m² | Binder Amount g/m² | Ag to Binder Ratio | Emulsion | Ag Amount g/m² | Binder Amount g/m² | Ag to Binder Ratio | Mark Occurrence Rank No. | Remarks |
| 1 | mix | 0.6 | 0.7 | 0.86 | mix | 0.55 | 0.65 | 0.85 | mix | 0.55 | 0.65 | 0.85 | 2 | Comp. |
| 2 | Em-1 | 0.6 | 0.7 | 0.86 | Em-2 | 0.55 | 0.65 | 0.85 | Em-3 | 0.55 | 0.65 | 0.85 | 2 | Comp. |
| 3 | Em-3 | 0.6 | 0.7 | 0.86 | Em-2 | 0.55 | 0.65 | 0.85 | Em-3 | 0.55 | 0.65 | 0.85 | 2 | Comp. |
| 4 | Em-1 | 0.6 | 0.8 | 0.75 | Em-2 | 0.55 | 0.6 | 0.92 | Em-3 | 0.55 | 0.6 | 0.92 | 4.5 | Inv. |
| 5 | Em-1 | 0.6 | 0.65 | 0.92 | Em-2 | 0.55 | 0.75 | 0.73 | Em-3 | 0.55 | 0.6 | 0.92 | 2 | Comp. |
| 6 | Em-1 | 0.6 | 0.65 | 0.92 | Em-2 | 0.55 | 0.6 | 0.92 | Em-3 | 0.55 | 0.75 | 0.73 | 2 | Comp. |
| 7 | Em-1 | 0.6 | 0.9 | 0.67 | Em-2 | 0.55 | 0.55 | 1.0 | Em-3 | 0.55 | 0.55 | 1.0 | 5 | Inv. |
| 8 | Em-1 | 0.6 | 1.0 | 0.6 | Em-2 | 0.55 | 0.5 | 1.1 | Em-3 | 0.55 | 0.5 | 1.1 | 5 | Inv. |

The "mix" in the emulsion column represents a mixture emulsion of Em-1, Em-2 and Em-3 (1:1:1)

What is claimed is:

1. A silver halide photographic light sensitive material comprising a support and at least two silver halide emulsion layers comprising silver halide grains and a binder on each surface of the support, 50% or more of said support being comprised of a syndiotactic polystyrene, wherein a silver to binder ratio by weight of the silver halide emulsion layer closest to said support is lower than that of another silver halide emulsion layer on each side of said support.

2. The silver halide photographic light sensitive material of claim 1, wherein said silver to binder ratio by weight in the emulsion layer closest to a support is not less than 0.05 lower than that of another emulsion layer on each side of said support.

3. The silver halide photographic light sensitive material of claim 2, wherein said silver to binder ratio by weight in the emulsion layer closest to a support is not less than 0.1 lower than that of another emulsion layer on each side of said support.

4. The silver halide photographic light sensitive material of claim 1, wherein said binder is gelatin.

5. The silver halide photographic light sensitive material of claim 2, wherein a subbing layer is provided between the support and the silver halide emulsion layer.

6. The silver halide photographic light sensitive material of claim 1, wherein said silver halide grains are tabular silver halide grains having an aspect ratio of 2 to 10.

7. The silver halide photographic light sensitive material of claim 1, wherein said silver to binder ratio by weight of the highest sensitive silver halide emulsion layer is lower than that of another emulsion layer on each side of said support.

* * * * *